US005700765A

United States Patent [19]

Barnes et al.

[11] Patent Number: 5,700,765

[45] Date of Patent: Dec. 23, 1997

[54] ADDITIVE SYSTEM AND METHOD FOR EXTENDING THE SERVICE LIFE OF PETROLEUM BASED HYDRAULIC FLUIDS

[75] Inventors: John Franklin Barnes, Arlington; Karl N. Gutzke, Irving; Robert M. Hooks, Fort Worth, all of Tex.

[73] Assignee: NCH Corporation, Irving, Tex.

[21] Appl. No.: 510,640

[22] Filed: Aug. 3, 1995

Related U.S. Application Data

[63] Continuation of Ser. No. 182,652, Jan. 18, 1994, abandoned.

[51] Int. Cl.[6] ..... C09K 5/00; C09K 15/08; C09K 15/14; C10L 1/10

[52] U.S. Cl. ..... 508/378; 508/388; 508/390; 252/73; 252/78.1

[58] Field of Search ..... 252/32.7 E, 52 R, 252/45, 48.2, 49.7, 49.8, 73, 78.1; 508/372, 378, 388, 390, 584

[56] References Cited

U.S. PATENT DOCUMENTS

| | | | |
|---|---|---|---|
| 2,033,543 | 3/1936 | Ralston et al. . | |
| 3,389,088 | 6/1968 | Schar et al. | 252/73 |
| 3,826,745 | 7/1974 | Ryer et al. | 252/32.7 E |
| 3,910,994 | 10/1975 | Bloch et al. | 252/558 |
| 3,974,081 | 8/1976 | Rutkowski et al. | 252/79 |
| 4,029,588 | 6/1977 | Koch | 252/48.2 |
| 4,179,389 | 12/1979 | Mann | 252/32.7 |
| 4,192,757 | 3/1980 | Brewster | 252/32.7 |
| 4,419,251 | 12/1983 | Shim et al. | 252/32.7 |
| 4,738,795 | 4/1988 | Farnand | 252/340 |
| 5,002,673 | 3/1991 | Williams et al. | 252/8.555 |
| 5,013,465 | 5/1991 | Colclough | 252/32.7 |
| 5,102,573 | 4/1992 | Han et al. | 252/153 |
| 5,198,129 | 3/1993 | Hata | 252/32.7 |
| 5,262,508 | 11/1993 | Martella et al. | 252/48.2 |

OTHER PUBLICATIONS

"Lubrication and Lubricants," edited by Eric r. Braithwaite, Elsevier Publishing Company, Amsterdam–London–New York, 1967, p. 123 (Library of Congress Catalogue No. 66–20556), no month.

"Thermal Stability Test Procedure A", Cincinnati Milacron 10–SP–90045, pp. 3–1 –3–4, Mar. 30, 1995.

*Primary Examiner*—Douglas J. McGinty
*Assistant Examiner*—Mark Kopec
*Attorney, Agent, or Firm*—Gardere & Wynne, L.L.P.

[57] ABSTRACT

An additive system and method of use that significantly extend the service life of petroleum based hydraulic fluids, improve antiwear properties, improve demulsibility, condition and swell seals to prevent leaking, increase oxidation life, improve thermal stability, improve corrosion resistance, improve antifoam characteristics, reduce the acid number of used hydraulic oils, and exhibit improved shelf stability and improved low temperature performance when compared to additive systems previously known, the additive system containing as essential elements a stabilized zinc dialkyldithiophosphate, a substituted sulfolane, an alkyl phenol and an effective amount of a solvent alcohol component selected from $C_9$–$C_{11}$ or $C_{12}$–$C_{13}$ alcohols, or other suitable alcohol blends, with or without other suitable adjunctive solvents such as aromatics or aromatic/ketone blends. Where the solvent alcohol component does not include an aromatic, the amount of alcohol preferably ranges from about 5 to about 20 percent by weight of the additive. Where the alcohol component is used in combination with about 5 percent by weight of the additive of an aromatic or with an aromatic/ketone blend, the amount of the alcohol component may be as little as about 3 percent by weight of the additive composition.

37 Claims, No Drawings

ADDITIVE SYSTEM AND METHOD FOR EXTENDING THE SERVICE LIFE OF PETROLEUM BASED HYDRAULIC FLUIDS

This application is a file wrapper continuation of application Ser. No. 08/182,652 filed Jan. 18, 1994 now abandoned.

BACKGROUND OF THE INVENTION

1. Field of the Invention

This invention relates to a composition and method for treating new and used petroleum based hydraulic fluids of the antiwear (AW), rust and oxidation inhibited (R & O), or untreated petroleum oil types for extended life and improved performance.

2. Description of Related Art

In recent years, zinc dialkyldithiophosphate (ZDP) has become widely used as a hydraulic fluid additive to provide antiwear protection. Hydraulic fluids containing ZDP exhibit good demulsibility in addition to providing antiwear properties, rust inhibition and antioxidant properties. However, problems have been encountered in using ZDP-containing hydraulic fluids because the ZDP has been found to attack copper, bronze or silver-coated components of hydraulic systems. This has in turn led to the development of stabilized ZDP or sulfur/phosphorus (non-zinc or ashless) additive systems.

Even with the advantages achieved through use of the stabilized ZDP additive systems, petroleum based hydraulic oils undergo various changes during extended service that affect their performance and useful life. Such changes include, for example, additive depletion and breakdown, foaming, contamination, increased viscosity, increased corrosivity (due to water contamination), and the like. Exposure to high temperatures can cause oxidation accompanied by a corresponding increase in the acid number of the fluid and sludge formation. Exposure to low temperatures can cause wax separation and loss of fluidity. The degradation of hydraulic fluid can also cause related problems such as hardening of elastomeric seals in the devices in which the fluid is used, corrosion damage to internal metal surfaces with which it comes into contact, etc.

In order to avoid operational problems and equipment damage associated with the degradation of hydraulic fluids, they are typically replaced whenever the neutralization number (acid number) reaches 2.0 when tested by American Society for Testing and Materials (ASTM) D 3339 Standard Test Method for Acid Number of Petroleum Products by Semi-Micro Color Indicator Titration. The normal service life of a petroleum based hydraulic fluid in a particular application can therefore be considered to be the interval between installation of the fluid and the time when the acid number of the fluid reaches about 2.0. Accordingly, a reasonably priced additive is needed that can significantly increase the service life of hydraulic fluid without otherwise adversely affecting its properties or performance characteristics. Such an additive will desirably be shelf-stable, even when stored for prolonged periods of temperatures up to about 120° F. or the like.

SUMMARY OF THE INVENTION

According to the present invention, an additive system is provided that will significantly extend the service life of petroleum based hydraulic fluids. The additive system of the invention will improve antiwear properties, improve demulsibility, condition and swell seals to prevent leaking, increase oxidation life, improve thermal stability, improve corrosion resistance, improve antifoam characteristics, and reduce the acid number of used hydraulic oils. The subject additive also exhibits both improved shelf stability and improved low temperature performance when compared to additive systems previously known.

According to a preferred embodiment of the invention, an additive for used hydraulic fluids is provided that comprises as essential elements a stabilized ZDP, a substituted sulfolane, an alkyl phenol and an effective amount of a solvent alcohol component selected from $C_9$–$C_{11}$ or $C_{12}$–$C_{13}$ alcohols, or other suitable alcohol blends as described herein, with or without other suitable adjunctive solvents such as aromatics or aromatic/ketone blends. Where the solvent alcohol component does not include an aromatic, the amount of alcohol preferably ranges from about 5 to about 20 percent by weight of the additive. Where the alcohol component is used in combination with about 5 percent by weight of the additive of an aromatic or an aromatic/ketone blend, the amount of the alcohol component may be as little as about 3 percent by weight of the additive composition.

According to another preferred embodiment of the invention, a method is provided for extending the life of petroleum based hydraulic fluids that comprises the step of adding to a used hydraulic fluid having an acid number of 1.5 or lower a minor effective amount of an additive comprising as essential elements a stabilized ZDP, a substituted sulfolane, an alkyl phenol and an effective amount of a solvent alcohol component selected from $C_9$–$C_{11}$ or $C_{12}$–$C_{13}$ alcohols, or other suitable alcohol blends as described herein, with or without a suitable aromatic solvent or an aromatic solvent/ketone blend. According to a particularly preferred embodiment of the invention, the additive is added to the used hydraulic fluid in an amount ranging from about 6 to about 6.5 percent by weight for used antiwear (AW) hydraulic fluids, and from about 9.5 to 13.5 percent by weight for used rust and oxidation inhibited oils (R&O) and used untreated base oils. The amount of solvent alcohol component present in the additive employed in the method of the invention preferably ranges from about 5 percent to about 20 percent by weight of the additive. Where the alcohol is mixed with an aromatic or combined aromatic/ketone component in the additive, benefits are achieved with alcohol concentrations as low as about 3 percent by weight of the additive.

DESCRIPTION OF THE PREFERRED EMBODIMENTS

The additive system of the invention preferably comprises as essential elements a stabilized ZDP, an alkyl phenol, substituted sulfolane, and an effective amount of a solvent component selected from $C_9$–$C_{11}$ or $C_{12}$–$C_{13}$ alcohols or other suitable alcohol blends as described below, with or without other suitable adjunctive solvents such as aromatics or aromatics in combination with a ketone.

It should be understood that the stabilized ZDP, known to the industry as a "package additive" and intended for use in hydraulic fluids, will contain not only ZDP for antioxidant, antiwear, and corrosion inhibiting properties, but also other additives essential to hydraulic fluid performance such as antioxidants of the alkyl phenol type, basic components such as calcium sulfonate (which functions as a corrosion inhibitor for ferrous metals, contributes some antiwear, and helps prevent acid hydrolysis of the di-esters on the ZDP), corrosion inhibitors for yellow metals (copper alloys), ZDP stabilizing additives, and a demulsifier (usually of the polyether type).

The reaction to obtain dithiophosphoric acid and the subsequent reaction of two moles of dithiophosphoric acid with zinc oxide to get ZDP starts initially by reacting an aliphatic or cycloaliphatic alcohol or phenol or combinations of these with phosphorous pentasulfide ($P_2S_5$). This reaction is shown in "Lubricants and Lubrication," edited by Eric R. Braithwaite, Elsevier Publishing Company, Amsterdam-London-New York, 1967, pg. 123 (Library of Congress Catalogue Number 66-20556) and is as follows:

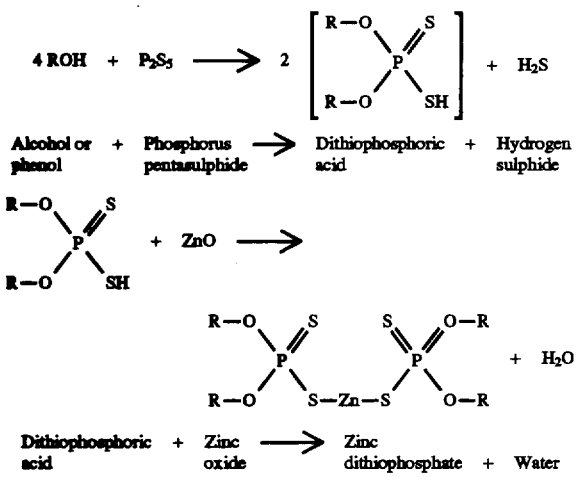

(ROH = An alcohol or phenol, such as lauryl, octyl, cyclohexyl, or methyl cyclohexylalcohol, or amyl or butyl phenols.)

In the reaction R is an alkyl, cycloalkyl, or aryl radical supplied by the alcohols or phenols used in the reaction. The di-esters are the RO-groups attached to the phosphorus. Acid hydrolysis of these di-esters theoretically split off the alkyl, cycloalkyl or aryl radicals to again form the alcohols or phenols leaving a hydroxyl group which is acidic attached to the phosphorous of the ZDP. (See U.S. Pat. Nos. 2,261,047 and 2,838,555 for prior art teaching on the structure of ZDP and dithiophosphoric acid di-ester groups.) As noted above, basic components are used in the stabilized ZDP additive to help prevent acid hydrolysis.

When a stabilized ZDP is combined with an alkyl phenol, a substituted sulfolane and alcohols in an additive system for used hydraulic fluids, the resultant additive is found to lower the acid number, swell and condition seals to prevent leakage, and significantly extend the service life of the fluids. However, when a stabilized ZDP containing a demulsifier is mixed with a substituted sulfolane and then combined with carrier oils and diluents such as solvent neutral oils, undesirable separation especially of the demulsifier and substituted sulfolane has been observed in the resultant compositions, especially when they are stored for prolonged periods at elevated temperatures. A solvent system is therefore needed to prevent such separation during storage and use.

It has been discovered that the addition of a solvent component comprising a minor effective amount of preferably $C_9$–$C_{11}$ or $C_{12}$–$C_{13}$ alcohols or other functionally equivalent alcohol blends (with or without a suitable aromatic solvent alone or an aromatic solvent blended with a ketone) will prevent separation of the polyether demulsifier portion of the stabilized ZDP and the substituted sulfolane, even during prolonged storage prior to use.

According to one preferred embodiment of the invention, an effective amount of the alcohol solvent component will range from about 5 to about 20 percent by weight of the additive, although amounts as low as about 3 weight percent of the alcohol solvent component may be satisfactorily used where the alcohol is combined with about 5 percent of an aromatic or an aromatic/ketone mixture by weight of the additive.

In the inventive compositions it has been discovered that the use of a concentrate comprising a stabilized ZDP in combination with an alkyl phenol, a substituted sulfolane and a minor effective amount of $C_9$–$C_{11}$ or $C_{12}$–$C_{13}$ primary alcohols or other suitable alcohol blends, and optionally with an aromatic or aromatic/ketone blend, will effectively reduce the acid number of used petroleum based hydraulic fluids in service and substantially increase their oxidation life when tested by ASTM D 943, Standard Test Method for Oxidation Characteristics of Inhibited Mineral Oils. It will also provide seal swelling (positive change in volume) and conditioning of elastomeric seals of the type normally used to seal hydraulic systems using petroleum based hydraulic fluids when tested in accordance with ASTM D 471, Standard Method for Rubber Property-Effect of Liquids.

It has been further discovered that the $C_9$–$C_{11}$ or $C_{12}$–$C_{13}$ alcohols or other suitable alcohol blends alone or with other suitable solvents not only allow for solubilizing, concentrating, and stabilizing against separation of the additives of the inventive compositions beyond the normal amount that can be accomplished in petroleum solvent neutral oils alone, but are additionally directly involved in prolonging or extending oxidation life or the time required, when tested by ASTM D 943, to reach an acid number of 2.0, a value which would indicate needed replacement of the hydraulic fluid. The inventive compositions not only function to increase the life of used petroleum based hydraulic fluids but can substantially increase the life, or time to reach an acid number of 2.0, of new or unused (incipiently used) commercial AW and R & O type hydraulic fluids as well. These desirable advantages are achieved without the addition of extra basic calcium sulfonate or phenate to a stabilized ZDP for the purpose of reducing the acid number of the used hydraulic fluid as might otherwise be expected in view of prior teachings and other commercially available compositions.

Although the mechanisms involved in achieving the benefits observed through use of the subject invention are not fully understood, it is believed that the $C_9$–$C_{11}$ or $C_{12}$–$C_{13}$ alcohols or other suitable alcohol blends function as coupling or solubilizing agents for the polyether demulsifier in the ZDP and the substituted sulfolane, thereby promoting solubility of the whole stabilized ZDP additive system and substituted sulfolane into the solvent neutral oils of the inventive compositions in which they would otherwise be insoluble at the amounts used.

The $C_9$–$C_{11}$ alcohols (equal percentages of nonyl, decyl, undecyl alcohols—average molecular weight 160) and $C_{12}$–$C_{13}$ alcohols (dodecyl and tridecyl alcohols—average molecular weight 194) were the first solvents used successfully with or without other solvents to solubilize and concentrate the additives in the inventive compositions, though many other solvent combinations were tried including aliphatic and aromatic hydrocarbons, glycol ethers, glycol ether acetates, esters, diesters, ketones, pine oil, and propylene carbonate. The $C_9$–$C_{11}$ and $C_{12}$–$C_{13}$ alcohols perform very effectively for the purpose of this invention for solubilizing and concentrating the stabilized ZDP, substituted sulfolane and other additives in the presence of solvent neutral oils to prevent additive separation on extended storage at elevated temperatures.

The $C_9$–$C_{11}$ and $C_{12}$–$C_{13}$ alcohols have several advantages over other alcohols which might be considered for use in that they are completely miscible with petroleum oils, are of the same approximate viscosity as the hydraulic fluids to which the inventive compositions they are in would be added, and have flash points high enough to minimize flash point reduction of the hydraulic fluids to be treated.

Since solubilization and concentration of all additives in the compositions of this invention are believed essential to obtain the benefits earlier described, a study was made to determine if the $C_9$–$C_{11}$ and $C_{12}$–$C_{13}$ alcohols and other solvents were the most efficacious for this purpose. Results of this study are shown in Table 1. It is apparent from this study that the shortest chain length alcohol, individually, that effects solubilization of the compositions is decyl alcohol. It is apparent, also, that the $C_{14}$–$C_{15}$ alcohols are the longest chain lengths that effect solubilization. It is evident from this study that the $C_9$–$C_{11}$ and $C_{12}$–$C_{13}$ alcohol blends or individual alcohols from decyl through tridecyl are the most desirable for solubilization. The $C_{14}$–$C_{15}$ blend does provide solubilization and can be used but is less desirable since it has a high pour point of 84° F. $C_9$–$C_{11}$ alcohols, as regards pour point, are the most desirable with a pour point of 10° F. The $C_{12}$–$C_{13}$ alcohols have a pour point of 66° F. At the lower percentages within the range at which the alcohols are used in the compositions of the invention, the pour points are not too critical, but at percentages higher than 5 percent they must be considered.

The information in Table 1 shows that nonyl alcohol alone does not solubilize the additives in compositions of this invention but with its presence as one third of the blend in the $C_9$–$C_{11}$ alcohols, it does not hinder solubilization ($C_9$–$C_{11}$ alcohols have same approximate average molecular weight as decyl alcohol). Earlier studies with one aromatic solvent (as shown in Example 1) show that it almost solubilizes the additives in the compositions but allows some slight separation on storage at elevated temperatures.

Another study was made to determine if blends of longer and shorter chain length alcohols blended to the average molecular weights of the $C_9$–$C_{11}$ and $C_{12}$–$C_{13}$ alcohols, or to other average molecular weights (e.g., an aromatic solvent blended with $C_9$–$C_{11}$ alcohols; a blend of $C_9$–$C_{11}$ alcohols, an aromatic solvent and methyl amyl ketone) would produce the desired solubility of additives in the compositions. Table 2 shows the results of this study. Solvent blend composition numbers 1 through 21 were used at 5 percent, number 22 at 5.5 percent, number 23 at 6 percent, number 24 at 7 percent, number 25 at 8 percent, and number 26 at 14 percent in attempts to achieve solubilization of the additives used in the inventive compositions. Numbers shown in Table 2 are the percentage portion of each of the final percentages of the solvent used (e.g., in blend number 1 iso-butyl alcohol comprises 2.45 percent and hexadecyl alcohol comprises 2.55 percent for a total of 5 percent). On initial tests using an accelerated test method for additive separation (heating one week at 120° F. and then centrifuging), it appeared that blend compositions (specifically 2, 3, 4, 5, 8, 9, 10, 12, 13, 15, 17, 19 and 20 shown in Table 2) blended in most cases to the average molecular weight of the $C_9$–$C_{11}$ or $C_{12}$–$C_{13}$ alcohols, would be suitable for prevention of additive separation for 90 days at 120° F. Full term (90 day) tests showed this to be incorrect and that only certain blends of lower molecular weight alcohols with $C_9$–$C_{11}$ or $C_{12}$–$C_{13}$ alcohols (such as for example 14, 16, 18 and 21), an aromatic solvent blended with the $C_9$–$C_{11}$ or $C_{12}$–$C_{13}$ alcohols (blend 25 is an example), and a blend of $C_9$–$C_{11}$ or $C_{12}$–$C_{13}$ alcohols, an aromatic solvent and methyl amyl ketone (blend 26 is an example), produce the desired solubilization and concentration of the additives in the inventive compositions. Other blends of suitable aliphatic and cycloaliphatic alcohols and solvents suitable for the intended purpose can be deduced from information in this table as those skilled in the art will recognize upon reading this disclosure.

According to another preferred embodiment of the invention, a method is provided for extending the life of petroleum based hydraulic fluids that comprises the step of adding to a used hydraulic fluid having an acid number of 1.5 or lower a minor effective amount of an additive comprising as essential elements a stabilized ZDP, a substituted sulfolane, an alkyl phenol and an effective amount of a solvent alcohol component selected from $C_9$–$C_{11}$ or $C_{12}$–$C_{13}$ alcohols, or other suitable alcohol blends as described herein, with or without a suitable aromatic solvent or an aromatic solvent/ketone blend. According to a particularly preferred embodiment of the invention, the additive is added to the used hydraulic fluid in an amount ranging from about 6 to about 6.5 percent by weight for used antiwear (AW) hydraulic fluids, and from about 9.5 to 13.5 percent by weight for used rust and oxidation inhibited oils (R&O) and used untreated base oils. The amount of solvent alcohol component present in the additive employed in the method of the invention preferably ranges from about 5 percent to about 20 percent by weight of the additive. Where the alcohol is mixed with an aromatic or combined aromatic/ketone component in the additive, benefits are achieved with alcohol concentrations as low as about 3 percent by weight of the additive.

By extending the service life of used hydraulic fluids, the composition and method of invention also reduce the environmental impact and disposal difficulties associated with used hydrocarbon-containing materials.

The discovery that the $C_9$–$C_{11}$ and $C_{12}$–$C_{13}$ alcohols (or other suitable alcohol blends with or without an aromatic solvent or aromatic solvent and a ketone) gave oxidation life extension on the ASTM D 943 test was unexpected. Solubilization and concentration of the additive components of the inventive compositions were the primary objectives originally sought by use of the alcohols, alcohol blends, aromatic solvent and ketone. Data presented below indicates, however, that the alcohols are also apparently responsible for the oxidation life extension observed on the ASTM D 943 test. A hydraulic fluid additive similar to but not the subject of this invention, using only an aromatic solvent (or other non-alcoholic solvent), displays only the oxidation life extension that is obtained from the stabilized ZDP and other additives identical to those of the inventive compositions, which is longer than that of the original hydraulic fluid, but is shorter than the life extension of hydraulic fluids treated with the embodiments of this invention which use alcohols or alcohols blended with other solvents.

It is believed that oxidation life extension imparted to new and used petroleum based hydraulic fluids may be the result of a chemical equilibrium between the excess $C_9$–$C_{11}$ and $C_{12}$–$C_{13}$ primary alcohols or other suitable alcohol blends in the additive compositions and the aliphatic or cycloaliphatic alcohols or phenols used to form the di-ester groups of the stabilized ZDP.

Acid hydrolysis of the di-ester groups on the ZDP is thought to be one method of destruction for the ZDP molecule in the presence of acidic water. Since in the ASTM D 943 test there are 60 milliliters (ml.) of water for each 300 ml of hydraulic fluid being tested, there is no lack of water for hydrolysis. Actual tests show that this water runs at a pH of 3 to 5 much of the time after the test is underway and temperature of the test is at 95° C. (203° F.). Conditions therefore favor acid hydrolysis. In actual use applications of hydraulic fluids, much the same conditions prevail as in the ASTM D 943 test. Water is inevitably present, as are high temperatures, in working hydraulic systems.

It is believed that the excess of $C_9$–$C_{11}$ and $C_{12}$–$C_{13}$ primary alcohols or other suitable alcohol blends in the hydraulic fluids serve to set up a chemical equilibrium wherein rates of hydrolysis of the di-ester groups on the ZDP are offset by rates of esterification by the $C_9$–$C_{11}$, $C_{12}$–$C_{13}$ primary alcohols or other suitable alcohols, thereby stabilizing the structure of the ZDP and maintaining and prolonging its function as an antiwear, oxidation and corrosion inhibiting additive.

If the belief that stabilization of the ZDP molecule by chemical equilibrium due to an excess of the $C_9$–$C_{11}$ and $C_{12}$–$C_{13}$ primary alcohols or other suitable alcohol blends is true, then other applications not requiring additive solubilization and concentration which use ZDP (or stabilized ZDP) could make use of an excess of shorter chain length or lower molecular weight alcohols to accomplish maintenance and life extension of the ZDP structure by chemical equilibrium at the di-ester groups, providing such shorter chain length or lower molecular weight alcohols are soluble in petroleum solvent neutral oils or the fluid in which the ZDP is to be used.

One embodiment of a hydraulic fluid additive, similar to but not the subject of this invention, is shown in Example 1. While the aromatic solvent alone in this example does not prevent separation of the demulsifier in the stabilized ZDP and the substituted sulfolane on extended storage at elevated temperatures, the components can be combined by stirring together at 125° F. and then be added immediately to a hydraulic fluid to be tested before separation of the additives can occur. Once in the hydraulic fluid at the recommended treat rate, concentrations of the additives are low enough to remain permanently in solution. Use of Example 1 as a reference additive system demonstrates that the additive system without alcohols does not produce the oxidation life extension on the ASTM D 943 test as do Examples 2 through 8 that contain the $C_9$–$C_{11}$ and $C_{12}$–$C_{13}$ primary alcohols or other alcohol blends.

Various embodiments of the invention are shown in Examples 2 through 8. Data is presented to show oxidation life extension on the ASTM D 943 test on Examples 1 through 6 with Example 1 serving as a reference for the total additive system without the use of alcohols. Examples 2 through 6 have data presented to show not only the oxidation life extension but also other improvements imparted to new and used hydraulic fluids by use of the various embodiments of the invention. Examples 7 and 8 are shown only to show the degree to which the additive system can be concentrated in the presence of the solvent neutral oils by employing suitable alcohols in amounts up to twenty percent and not be subject to separation on extended storage at elevated temperatures.

Since Example 7 contains twice the additive concentration (dye percentage remains the same) of Examples 2 through 6, the treat rate when using this embodiment is half the amount stated earlier for treating AW hydraulic fluids or 3 to 3.25 percent by weight. Likewise for the R & O hydraulic fluids, the treat rate would be 4.5 to 6.75 percent by weight. Example 8 contains four times the additive concentration so the treat rate when using this embodiment would be one fourth the treat rate stated earlier or 1.5 to 1.63 percent by weight for AW hydraulic fluids and 2.38 to 3.38 percent by weight for R & O hydraulic fluids. Preparation or making of the various embodiments, Examples 1 through 8, are accomplished in a similar manner. In each case, the solvents and solvent neutral oils are first combined in the proportions stated for each example in a suitable mixing vessel and heated to 120° to 130° F. with good stirring to assure uniform mixing. Thereafter, the remainder of the components in the proportions shown for each example are added in the order indicated to the solvent and solvent neutral oils with stirring while maintaining the contents of the mixing vessel at 120° to 130° F. After all components are in, stirring is continued for thirty minutes to an hour to assure a uniformly mixed product.

The exception to the above is Example 5. In this example a basic 65 TBN calcium phenate is first mixed with the stabilized ZDP in a suitable vessel at 120° to 130° F. in the proportions shown until uniformly mixed. Example 5 is then prepared or made as previously described for Examples 1 through 8 except that the ZDP and calcium phenate are added as one component. The various embodiments of this invention, Examples 2 through 6, and Example 1 as a reference, were tested in six commercial hydraulic fluids or Oils A through F to confirm their oxidation life extension performance by the ASTM D 943 test methods (Table 3–10, respectively), and by other ASTM test methods to confirm other performance parameters. On Oils A and B both the new untreated fluids (Tables 3 and 5, respectively) or oils and the equivalent used untreated oils (Tables 4 and 6, respectively) were tested. The used oils came from hydraulic presses being used to form plastic containers. The exact service life of the oils was not known but selection of them was based on their acid or neutralization numbers rather than service life.

One of the test procedures used to evaluate the oils, the Cincinnati Milacron Thermal Stability Test "A", is not an ASTM test. This test procedure is found in a booklet entitled, "Special Manual, Lubricants, Purchase Specifications, Approved Products, Publication No. 10-SP-90045, Part No. 3429351," and is available from Cincinnati Milacron, 4701 Marburg Avenue, Cincinnati, Ohio 45209. Their specification numbers P-68, P-69, and P-70 are applicable to hydraulic oils and define the specification limits for hydraulic oils to pass on the Thermal Stability Test "A".

Pump tests were run according to ASTM D 2882 on Used Oil A (Table 4), on Used Oil B and Used Oil B treated with Example 1 (Table 6), on New Oil C and New Oil C treated with Example 1 (Table 7), and on New Oil D and New Oil D treated with Example 1 (Table 8) and New Oil F (Table 10).

Test results on Used Oil A as shown in Table 4 are far below the 50 mg., maximum loss allowed to pass the Vickers, Inc. (a TRINOVA Company) pump wear test specification for the 100 hour period and is still passing at the 300 hour period. Used Oil A was not treated and tested with Example 1 because it was felt no significantly better results could be expected. Oil A is made with a stabilized ZDP and the oil used in it is hydrotreated, making it a very stable oil on which long oxidation life extension can be obtained on the D 943 test. The stabilized ZDP undoubtedly accounts for the good pump wear test results on the used oil.

Test results from testing by ASTM D 2882 on Used Oil B and Used Oil B treated with Example 1 are shown in Table 6 and indicate the improvement the Example 1 reference embodiment can have on a used hydraulic oil.

New Oils C and D, Tables 7 and 8 respectively, and New Oils C and D treated with Example 1 were all run according to ASTM D 2882. The treated oils showed some increase in wear but are still well below the 50 mg., maximum allowed on the Vickers pump wear test requirement. The precision and bias on this test have not been determined, but industry wide knowledge on precision of the test would rate the results obtained between new Oils C and D and their treated versions as being very good checks.

New Oil F, an R & O hydraulic oil, was tested according to ASTM D 2882. The test results for it shown in Table 10 are typical for R & O hydraulic oils.

Because of the time required to run the ASTM D 2882 tests, no further tests were run by this method. ASTM D 4172, Wear Preventive Characteristics of Lubricating Fluid (Four Ball Method), was used to check those oils run by ASTM D 2882 and these results used as a reference to determine that Oils A through F exhibited satisfactory wear results when treated with Examples 2 through 6 containing the $C_9$–$C_{11}$, or $C_{12}$–$C_{13}$ primary alcohols or the $C_9$–$C_{11}$ primary alcohols blended with an aromatic solvent and a ketone.

The oxidation life extension to an acid number of 2 as determined by ASTM D 943 varies from oil to oil. On New Oil A, Table 3, oxidation life was 3600 hours. Treated with Example 1 it was 3850 hours. This is an increase in life of 7%. It is felt that this life would have been longer if treated with any of Examples 2 through 6. The long life of Oil A suggests it is composed of a stabilized ZDP additive and a hydrotreated petroleum oil as stated earlier.

On Used Oil A, Table 4, two sets of data are given on oxidation life extension based on different acid numbers of Samples 1, 2 and 3 for Used Oil A. Life on Used Oil A, untreated, was 564 hours. Treated with Example 1, its life was 1526 hours or an increase of 170%. Life on the second sample of Used Oil A, untreated, was 1200 hours. Treated with Example 1, life on this sample was 1560 hours or an increase of 30%. Assuming a base time of 1200 hours for Sample 3, the increase in life was 1900 hours when treated with Example 3 and 1620 hours when treated with Example 5, which is a 58% and 35% increase in life, respectively. The addition of the 65 Total Base Number (TBN) calcium phenate did give a good life increase but not as great as when the $C_9$–$C_{11}$ primary alcohols (included in Example 3) were used to treat Used Oil A. The remainder of the oxidation life extension will be self evident with the explanation just concluded.

Hydrolytic Stability tests according to ASTM D 2619 were run on New and Used Oil A, New (Table 5) and Used (Table 6) Oil B and on each of these treated with the reference embodiment, Example 1. Both Used Oil A and B showed poor separation on this test but it is believed these would be greatly improved with Examples 2 through 6 since their use greatly improved the demulsibility (ASTM D 1401) of the used oils.

Oils A through F, New (Tables 3, 5 and 7–10 respectively) and A and B, respectively Used (Table 4 and 6, respectively) were checked for wear preventing characteristics by ASTM D 4172 as were their treated versions using Example 1. In nearly all cases, the new or used oils when treated with Examples 2 through 6 were as good as, or better than the New or Used Oil untreated and treated with Example 1 keeping in mind that precision (repeatability-one operator, same apparatus) is 0.12 millimeter wear scar diameter. Used Oil B was not treated with Examples 2 through 6 for testing due to a limited supply of the oil.

Interpretation of the Cincinnati Milacron Thermal Stability Test "A" for all oils tested can be readily accomplished using Cincinnati Milacron's Publication No. 10-SP-90045 referenced earlier.

The Turbine Oil Rust Test, ASTM D 665 was determined at both a 24 hour test period (the time called for in the test) and a 48 hour test period because some hydraulic oils will pass the 24 hour test and fail the 48 hour test. Used Oils A and B failed the 24 hour test but when treated with reference additive Example 1 or Examples 2 through 6, they passed the 48 hour test.

New and Used Oils A and B (Table 5 and 6, respectively) and their treated versions using Example 1 passed the ASTM D 892 Foam Test. In a modified foam test there was no indication of foaming on any of the oils, new or used, when treated with Example 2 through 6.

Seal Swell Tests according to ASTM D 471 showed desirable positive volume increases in the +1 to +5 percent range for all of the oils when treated with Examples 1 through 6.

EXAMPLE 1

One embodiment of a hydraulic fluid additive, similar to but not the subject of this invention, utilizes a heavy aromatic hydrocarbon solvent only and is made by combining the following components in the proportions stated below:

| | wt. % | vol. % |
|---|---|---|
| Aromatic 150 Solvent[1] | 5.0 | 5.00 |
| 150 SNO[2] | 13.45 | 13.91 |
| 600 SNO[2] | 65.71 | 66.97 |
| Lubrizol 5178F[3] | 6.4 | 5.58 |
| Lubrizol 730[4] | 6.4 | 5.60 |
| Ethyl Hitec 4733[5] | 2.0 | 1.92 |
| Vanlube DF 283[6] | 0.5 | 0.48 |
| Lubrizol 6662[7] | 0.5 | 0.50 |
| Red Dye | 0.04 | 0.04 |
| | 100.00 | 100.00 |

[1]An aromatic hydrocarbon solvent with a boiling range from about 362 to 410° F. made by Exxon Company, U.S.A.
[2]Solvent neutral oil.
[3]A stabilized ZDP antiwear hydraulic oil additive made by the Lubrizol Corp.
[4]A substituted sulfolane made by the Lubrizol Corp. used as a seal swell agent.
[5]An alkyl phenol oxidation inhibitor made by Ethyl Corp.
[6]A defoamer made by R.T. Vanderbilt Co., Inc.
[7]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 2

One embodiment of the hydraulic fluid additive of the invention, utilizing a mixture of $C_9$–$C_{11}$ alcohols as the solvent, is made by combining the following components in the preferred proportions stated below:

| | wt. % | vol. % |
|---|---|---|
| Neodol91[1] | 5.0 | 5.36 |
| 150 SNO[2] | 29.29 | 30.11 |
| 600 SNO[2] | 49.87 | 50.50 |
| Lubrizol 5178F[3] | 6.4 | 5.54 |
| Lubrizol 730[4] | 6.4 | 5.57 |
| Ethyl Hitec 4733[5] | 2.0 | 1.91 |
| Vanlube DF 283[6] | 0.5 | 0.48 |
| Lubrizol 6662[7] | 0.5 | 0.49 |
| Red Dye | 0.04 | 0.04 |
| | 100.00 | 100.00 |

[1]A $C_9$–$C_{11}$ alcohol made by Shell Chemical Co.
[2]Solvent neutral.
[3]A stabilized ZDP antiwear hydraulic oil additive made by the Lubrizol Corp.
[4]A substituted sulfolane made by the Lubrizol Corp. used as a seal swell/agent.
[5]An alkyl phenol oxidation inhibitor made by Ethyl Corp.
[6]A defoamer made by R.T. Vanderbilt Co., Inc.
[7]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 3

Another embodiment of the hydraulic fluid additive of the invention, utilizing a solvent system comprising a mixture of $C_9$–$C_{11}$ alcohols together with other solvents, is made by combining the following components in the preferred proportions stated below:

| | wt. % | vol. % |
|---|---|---|
| Neodol91[1] | 5.0 | 5.45 |
| Aromatic 150 Solvent[2] | 7.0 | 7.07 |
| Methyl Amyl Ketone | 2.0 | 2.22 |
| 150 SNO[3] | 56.13 | 56.55 |
| 600 SNO[3] | 14.03 | 14.44 |
| Lubrizol 5178F[4] | 6.4 | 5.63 |
| Lubrizol 730[5] | 6.4 | 5.66 |
| Ethyl Hitec 4733[6] | 2.0 | 1.95 |
| Vanlube DF 283[7] | 0.5 | 0.49 |
| Lubrizol 6662[8] | 0.5 | 0.50 |
| Red Dye | 0.04 | 0.04 |
| | 100.00 | 100.00 |

[1]A $C_9$–$C_{11}$ alcohol made by Shell Chemical Co.
[2]An aromatic hydrocarbon solvent with a boiling range from about 362–410° F. made by Exxon Company, U.S.A.
[3]Solvent neutral oil.
[4]A stabilized ZDP antiwear hydraulic oil additive made by the Lubrizol Corp.
[5]A substituted sulfolane made by the Lubrizol Corp. used as a seal swell agent.
[6]An alkyl phenol oxidation inhibitor made by Ethyl Corp.
[7]A defoamer made by R.T. Vanderbilt Co., Inc.
[8]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 4

One embodiment of the hydraulic fluid additive of the invention, utilizing a mixture of $C_{12}$–$C_{13}$ alcohols as the solvent, is made by combining the following components in the preferred proportions stated below:

| | wt. % | vol. % |
|---|---|---|
| Neodol 23[1] | 5.0 | 5.34 |
| 150 SNO[2] | 30.4 | 31.25 |
| 600 SNO[2] | 48.76 | 49.38 |
| Lubrizol 5178F[3] | 6.4 | 5.54 |
| Lubrizol 730[4] | 6.4 | 5.57 |
| Ethyl Hitec 4733[5] | 2.0 | 1.91 |
| Vanlube DF 283[6] | 0.5 | 0.48 |
| Lubrizol 6662[7] | 0.5 | 0.49 |
| Red Dye | 0.04 | 0.04 |
| | 100.00 | 100.00 |

[1]A $C_{12-C13}$ alcohol made by Shell Chemical Co.
[2]Solvent neutral oil.
[3]A stabilized ZDP antiwear hydraulic oil additive made by the Lubrizol Corp.
[4]A substituted sulfolane made by Lubrizol Corporation used as a seal swell agent.
[5]An alkyl phenol oxidation inhibitor made by Ethyl Corp.
[6]A defoamer made by R.T. Vanderbilt Co., Inc.
[7] A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 5

One embodiment of the hydraulic fluid additive of the invention, utilizing a mixture of $C_{12}$–$C_{13}$ alcohols as the solvent, is made by combining the following components in the preferred proportions stated below:

| | wt. % | vol. % |
|---|---|---|
| Neodol 23[1] | 5.0 | 5.34 |
| 150 SNO[2] | 30.4 | 31.26 |
| 600SNO[2] | 48.34 | 48.97 |
| Lubrizol 5178F[3] | 6.4 | 5.54 |
| Lubrizol 89[4] | 0.42 | 0.40 |
| Lubrizol 730[5] | 6.4 | 5.57 |
| Ethyl Hitec 4733[6] | 2.0 | 1.91 |
| Vanlube DF 283[7] | 0.5 | 0.48 |
| Lubrizol 6662[8] | 0.5 | 0.49 |
| Red Dye | 0.04 | 0.04 |
| | 100.00 | 100.00 |

[1]A $C_{12}$–$C_{13}$ alcohol made by Shell Chemical Co.
[2]Solvent neutral oil.
[3]A stabilized ZDP antiwear hydraulic oil additive made by the Lubrizol Corp.
[4]A basic (65TBN) calcium phenate detergent made by Lubrizol Corporation
[5]A substituted sulfolane made by the Lubrizol Corp. used as a seal swell agent.
[6]An alkyl phenol oxidation inhibitor made by Ethyl Corp.
[7]A defoamer made by R.T. Vanderbilt Co., Inc.
[8]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 6

One embodiment of the hydraulic fluid additive of the invention, utilizing a mixture of $C_9$–$C_{11}$ alcohols as the solvent, is made by combining the following components in the preferred proportions stated below:

| | wt. % | vol. % |
|---|---|---|
| Neodol91[1] | 20.0 | 21.28 |
| 150 SNO[2] | 22.456 | 22.90 |
| 600 SNO[2] | 41.704 | 41.90 |
| Lubrizol 5178F[3] | 6.4 | 5.50 |
| Lubrizol 730[4] | 6.4 | 5.52 |
| Ethyl Hitec 4733[5] | 2.0 | 1.90 |
| Vanlube DF 283[6] | 0.5 | 0.47 |
| Lubrizol 6662[7] | 0.5 | 0.49 |
| Red Dye | 0.04 | 0.04 |
| | 100.00 | 100.00 |

[1]A $C_9$–$C_{11}$ alcohol made by Shell Chemical Co.
[2]Solvent neutral oil.
[3]A stabilized ZDP antiwear hydraulic oil additive made by the Lubrizol Corp.
[4]A substituted sulfolane made by Lubrizol Corporation used as a seal swell agent.
[5]An alkyl phenol oxidation inhibitor made by Ethyl Corp.
[6]A defoamer made by R.T. Vanderbilt Co., Inc.
[7]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 7

One embodiment of the hydraulic fluid additive of the invention, utilizing a mixture of $C_9$–$C_{11}$ alcohols as the solvent, is shown only to demonstrate the degree to which the stabilized ZDP and sulfolane can be concentrated in the presence of solvent neutral oils without separation when stored ninety days at 120° F.

| | wt. % | vol. % |
|---|---|---|
| Neodol 91[1] | 20.0 | 21.70 |
| 150 SNO[2] | 24.18 | 25.15 |
| 600 SNO[2] | 24.18 | 24.78 |
| Lubrizol 5178F[3] | 12.80 | 11.23 |
| Lubrizol 730[4] | 12.80 | 11.26 |
| Ethyl Hitec 4733[5] | 4.00 | 3.87 |
| Vanlube DF 283[6] | 1.00 | 0.97 |
| Lubrizol 6662[7] | 1.00 | 1.00 |
| Red Dye | 0.04 | 0.04 |
| | 100.00 | 100.00 |

[1]A $C_9$–$C_{11}$ alcohol made by Shell Chemical Co.
[2]Solvent neutral oil.
[3]A stabilized ZDP antiwear hydraulic oil additive made by the Lubrizol Corp.
[4]A substituted sulfolane made by Lubrizol Corporation used as a seal swell agent.
[5]An alkyl phenol oxidation inhibitor made by Ethyl Corp.
[6]A defoamer made by R.T. Vanderbilt Co., Inc.
[7]A pour point depressant made by the Lubrizol Corp.

The resultant composition preferably has a viscosity in the same range as an ISO VG 46 hydraulic fluid or from about 41.4 to 50.6 centistokes at 40° C.

EXAMPLE 8

One embodiment of the hydraulic fluid additive of the invention, utilizing a mixture of $C_9$–$C_{11}$ alcohols as the solvent, is shown only to demonstrate the degree to which the stabilized ZDP and sulfolane can be concentrated in the presence of solvent neutral oils without separation when stored ninety days at 120° F.

| | wt. % | vol. % |
|---|---|---|
| Neodol 91[1] | 20.0 | 22.68 |
| 150 SNO[2] | 8.38 | 9.11 |
| 600 SNO[2] | 8.38 | 8.97 |
| Lubrizol 5178F[3] | 25.60 | 23.44 |
| Lubrizol 730[4] | 25.60 | 23.55 |
| Ethyl Hitec 4733[5] | 8.00 | 8.09 |

-continued

| | wt. % | vol. % |
|---|---|---|
| Vanlube DF 283[6] | 2.0 | 2.03 |
| Lubrizol 6662[7] | 2.00 | 2.09 |
| Red Dye | 0.04 | 0.04 |
| | 100.00 | 100.00 |

[1]A $C_9$–$C_{11}$ alcohol made by Shell Chemical Co.
[2]Solvent neutral oil.
[3]A stabilized ZDP antiwear hydraulic oil additive made by the Lubrizol Corp.
[4]A substituted sulfolane made by Lubrizol Corporation used as a seal swell agent.
[5]An alkyl phenol oxidation inhibitor made by Ethyl Corp.
[6]A defoamer made by R.T. Vanderbilt Co., Inc.
[7]A pour point depressant made by the Lubrizol Corp.

The resultant composition preferably has a viscosity in the same range as an ISO VG 46 hydraulic fluid or from about 41.4 to 50.6 centistokes at 40° C.

TABLE 1

| ALCOHOLS AND OTHER SOLVENTS | PREVENTS SEPARATION OF ADDITIVES IN INVENTIVE COMPOSITIONS AT 120° F. FOR 90 DAYS WHEN USED AT 5 PERCENT BY WEIGHT | MOLECULAR WEIGHT |
|---|---|---|
| ISO-BUTYL | NO | 74.13 |
| AMYL | NO | '188.15 |
| HEXYL | NO | 102.18 |
| CYCLOHEXYL | NO | 100.16 |
| ISO-OCTYL | NO | 130.23 |
| NONYL | NO | 144.26 |
| $C_9$–$C_{11}$ (NEODOL 91) | YES | 160* |
| DECYL | YES | 158.29 |
| $C_{12}$–$C_{13}$ (NEODOL 23) | YES | 194* |
| $C_{14}$–$C_{15}$ (NEODOL 45) | YES | 218* |
| HEXADECYL | NO | 242.45 |
| OCTADECYL | NO | 270.50 |
| AROMATIC 150 | NO | 138* |
| METHYL AMYL KETONE | NO | 114.19 |

*Average Molecular Weight

TABLE 2-A

| ALCOHOLS AND OTHER SOLVENTS | SOLVENT BLEND COMPOSITIONS 1 | 2 | 3 | 4 | 5 | 6 | 7 | 8 | 9 | 10 | 11 | 12 | 13 |
|---|---|---|---|---|---|---|---|---|---|---|---|---|---|
| ISO-BUTYL | 48.98 | | | | | 38.96 | | | | | 25.00 | | |
| AMYL | | 54.32 | | | | | 41.95 | | | | | 50.00 | |
| HEXYL | | | 68.78 | | | | | 45.22 | | | | | 50.00 |
| CYCLOHEXYL | | | | 57.95 | | | | | 44.91 | | | | |
| OCTYL | | | | | 73.47 | | | | | 54.63 | | | |
| $C_9$–$C_{11}$ (NEODOL 91) | | | | | | | | | | | 75.00 | 50.00 | 50.00 |
| $C_{12}$–$C_{13}$ (NEODOL 23) | | | | | | | | | | | | | |
| $C_{14}$–$C_{15}$ | | | | | | | | | | | | | |

TABLE 2-A-continued

| ALCOHOLS AND OTHER SOLVENTS | SOLVENT BLEND COMPOSITIONS 1 | 2 | 3 | 4 | 5 | 6 | 7 | 8 | 9 | 10 | 11 | 12 | 13 |
|---|---|---|---|---|---|---|---|---|---|---|---|---|---|
| (NEODOL 45) HEXADECYL OCTADECYL | 51.02 | 45.68 | 41.22 | 42.05 | 28.53 | 61.04 | 58.05 | 54.78 | 55.09 | 45.47 | | | |
| AROAMTIC 150 | | | | | | | | | | | | | |
| METHYL AMYL KETONE | | | | | | | | | | | | | |
| PREVENTS SEPARATION OF COMPONENTS IN ADDITIVE AT 120° F. FOR 90 DAYS | NO | NO | NO | NO | NO | NO | NO | NO | NO | NO | NO | NO | NO |
| AVERAGE MOLECULAR WEIGHT OF ALCOHOL BLENDS AND ALCOHOL AND OTHER SOLVENT BLENDS | 160 | 160 | 160 | 160 | 160 | 194 | 194 | 194 | 194 | 194 | 138.53 | 124.08 | 131.09 |

TABLE 2-B

| ALCOHOLS AND OTHER SOLVENTS | SOLVENT BLEND COMPOSITIONS 14 | 15 | 16 | 17 | 18 | 19 | 20 | 21 | 22 | 23 | 24 | 25 | 26 |
|---|---|---|---|---|---|---|---|---|---|---|---|---|---|
| ISO-BUTYL | | 28.36 | | | | | | | | | | | |
| AMYL | | | 32.12 | 50.00 | | | | | | | | | |
| HEXYL | | | | | 36.58 | | 50.08 | | | | | | |
| CYCLOHEXYL | | | | | | | | | | | | | |
| OCTYL | 50.00 | | | | | 58.84 | | 66.08 | | | | | |
| $C_9$–$C_{11}$ (NEODOL 91) | 50.00 | | | | | | | | 9.09 | 16.67 | 28.57 | 37.50 | 35.71 |
| $C_{12}$–$C_{13}$ (NEODOL 23) | | 71.64 | 87.77 | 50.00 | 63.42 | 47.16 | | | | | | | |
| $C_{14}$–$C_{15}$ (NEODOL 45) | | | | | | | 49.92 | 33.92 | | | | | |
| HEXADECYL | | | | | | | | | | | | | |
| OCTADECYL | | | | | | | | | | | | | |
| AROAMTIC 150 | | | | | | | | | 91.91 | 83.33 | 71.43 | 62.50 | 50.00 |
| METHYL AMYL KETONE | | | | | | | | | | | | | 14.28 |
| PREVENTS SEPARATION OF COMPONENTS IN ADDITIVE AT 120° F. FOR 90 DAYS | YES | NO | YES | NO | YES | NO | NO | YES | NO | NO | NO | YES | YES |
| AVERAGE MOLECULAR WEIGHT OF ALCOHOL BLENDS AND ALCOHOL AND OTHER SOLVENT BLENDS | 145.12 | 160 | 160 | 141.08 | 160 | 160 | 160 | 160 | 141.38 | 141.67 | 144.28 | 146.26 | 142.44 |

TABLE 3

| | PROCEDURE* | Hydraulic Oil A, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| PUMP PERFORMANCE | | | | | | | | |
| Vickers 104C Vane [2000 PSI, 1200 RPM, (50 Mg. Max. 65.6° C. (150°)] | D 2882 Loss at 100 Hours to Pass) | | | | | | | |
| 100 Hours | | | | | | | | |
| Ring Loss, Mg: | | | | | | | | |
| Vane Loss, Mg: | | | | | | | | |
| Total Loss, Mg: | | | | | | | | |
| 300 Hours | | | | | | | | |
| Ring Loss, Mg: | | | | | | | | |
| Ring Loss, Mg: | | | | | | | | |
| Toal Loss, Mg: | | | | | | | | |
| OXIDATION & CORROSION | | | | | | | | |
| Turbine Oil Oxidation Hours to 2.0 Neut. No: | D943 | 3600 | 3850 | | | | | |
| Hydrolytic Stability | D2619 | | | | | | | |
| Copper Weight Loss: ($Mg./cm^2$) | | 0.12 | 0.18 | | | | | |
| Copper Appearance | | 2C | 2C | | | | | |
| Water Layer, Neut | | | | | | | | |
| Mo. Mg. KOH: | | 0.0 | 0.6 | | | | | |
| Water Layer: | | Basic | — | | | | | |
| Wear preventing characteristics of Lubricating Fluid (Four Ball Method), 1200 RPM, 75° C. (167° F.), 40 Kg., 1 hour, Wear Scar Diameter, mm: | D4172 | 0.523 | 0.523 | | 0.432 | | 0.478 | 0.501 |
| Thermal Stability Test [168 Hours, 135° C. (275° F.) Copper, Steel Catalyst] | Cincinnati Milacron** | | | | | | | |
| Sludge (Mg./100 ML.) | | 1.0 | 0.8 | | | | | |
| Condition of Cu Rod 5 Max. to pass, (CM Color Class): | | 1 | 1 | | | | | |
| Condition of Fe Rod 1 Max. to pass, (CM Color Class): | | 1 | 1 | | | | | |
| Turbine Oil Rust Test Synthetic Seawater | D665 | | | | | | | |
| 24 Hrs: | | Pass | Pass | | Pass | | Pass | Pass |
| 48 Hrs: | | Pass | Pass | | Pass | | Pass | Pass |
| MISCELLANEOUS | | | | | | | | |
| Turbine Oil Demulsibility 54.4° C. (130° F.) ML: Oil-Water-Emulsion (Minutes) | D1401 | 40-40-0(10) | 40-40-0(10) | | 40-40-0(10) | | 40-40-0(10) | 40-40-0(10) |
| Foam (Temdency-Stability) (ML.) | D892 | | | | | | | |
| Sequence I | | 0–0 | 0–0 | | | | | |
| Sequence II | | 10–0 | 20–0 | | | | | |
| Sequence III | | 0–0 | 0–0 | | | | | |
| Seal Swell Test Percent change in Volume (Swell): | D471 (+1–5% Increase in volume for Leak Reduction | −1.49 | +2.1 | | +1.76 | | +1.96 | +2.93 |

*ASTM unless otherwise indicated

**CM Color Class 1 = polished copper or steel 10 = black copper or steel

TABLE 4

| | PROCEDURE* | Hydraulic Oil A, Used, Untreated | Treated with Example #1 | Treated with Example #2 | Treated with Example #3 |
|---|---|---|---|---|---|
| **PUMP PERFORMANCE** | | | | | |
| Vickers 104C Vane [2000 PSI, 1200 RPM, 65.6° C. (150°)] | D2882 (50 Mg. Max. Loss at 100 Hours to Pass) | | | | |
| **100 Hours** | | | | | |
| Ring Loss, Mg: | | 8.6[1] | not run because used oil passed test requirement | | |
| Vane Loss, Mg: | | 0.9[1] | | | |
| Total Loss, Mg: | | 9.5[1] | | | |
| **300 Hours** | | | | | |
| Ring Loss, Mg: | | 27.4[1] | | | |
| Ring Loss, Mg: | | 1.4[1] | | | |
| Total Loss, Mg: | | 28.8[1] | | | |
| **OXIDATION & CORROSION** | | | | | |
| Turbine Oil Oxidation Hours to 2.0 Neut. No.: | D943 | 564[1]<br>1200[2] | 1526[1]<br>1560[2] | | 1900[3] |
| Hydrolystic Stability Copper Weight Loss: (Mg./cm²) | D2619 | 0.19[1] | 0.66[1] | | |
| Copper Appearance | | 2C[1] | 2C[1] | | |
| Water Layer, Neut Mo. Mg. KOH: | | 5.8[1] | 5.8[1] | | |
| Water Layer: | | Poor separation Heavy cuff | Poor separation Heavy cuff | | |
| Wear preventing characteristics of Lubricating Fluid (Four Ball Method), 1200 RPM, 75° C. (167° F.,), 40 Kg., 1 hour, Wear Scar Diameter, mm: | D4172 | 0.698[1] | 0.512[1] | 0.538[2] | 0.586[3] |
| Thermal Stablility Test [168 Hours, 135° C. (275° F.) Copper, Steel Catalyst] | Cincinnati Milacron** | | | | |
| Sludge (Mg./100 ML.) | | 245.6[1]<br>25.6[2] | 1.8[1] | 3.5[3]<br>3.2[2] | 2.3[3] |
| Condition of Cu Rod 5 Max. to pas, (CM Color Class): | | 9[1]<br>6[2] | 4[1] | 2[3] | 2[3] |
| Condition of Fe Rod 1 Max. to pass, (CM Color Class): | 3[2] | 4[1] | 2[1]<br>1[3] | 1[3] | |
| Turbine Oil Rust Test Synthetic Seawater | D665 | | | | |
| 24 Hrs: | | Pass[1] | Pass[1] | Pass[3] | Pass[3] |
| 48 Hrs: | | Fail[1] | Pass[1] | Pass[3] | Pass[3] |
| **MISCELLANEOUS** | | | | | |
| Turbine Oil Demulsibility 54.4° C. (130° F.) ML: Oil-Water-Emulsion (Minutes) | D1401 | 40-40-0(60+)[1] | 40-40-0(20)[1] | 40-40-0(25)[2] | 40-40-0(35)[2] |
| Foam (Tendency-Stability) (ML.) | D892 | | | | |
| Sequence I | | 510–70[1] | 500–20[1] | | |
| Sequence II | | 90–0[1] | 70–0[1] | | |
| Sequence III | | 410–90[1] | 60–0[2] | | |
| Seal Swell Test Percent change in Volume (Swell): | D471 (+1–5% Increase in volume for Leak Reduction | −1.77[1] | +1.9[1] | | +1.52 |

TABLE 4-continued

| | Treated with Example #4 | Treated with Example #5 | Treated with Example #6 |
|---|---|---|---|
| PUMP PERFORMANCE | | | |
| Vickers 104C Vane [2000 PSI, 1200 RPM, 65.6° C. (150°)] | | | |
| 100 Hours | | | |
| Ring Loss, Mg: | | | |
| Vane Loss, Mg: | | | |
| Total Loss, Mg: | | | |
| 300 Hours | | | |
| Ring Loss, Mg: | | | |
| Ring Loss, Mg: | | | |
| Total Loss, Mg: | | | |
| OXIDATION & CORROSION | | | |
| Turbine Oil Oxidation Hours to 2.0 Neut. Nol | | 1620[3] | |
| Hydrolytic Stability | | | |
| Copper Weight Loss: ($Mg./cm^2$) | | | |
| Copper Appearance | | | |
| Water Layer, Neut | | | |
| Mo. Mg. KOH: | | | |
| Water Layer: | | | |
| Wear preventing characteristics of Lubricating Fluid (Four Ball Method), 1200 RPM, 75° C. (167° F.), 40 Kg., 1 hour, Wear Scar Diameter, mm: | 0.467[3] | 0.531[3] | 0.791[3] |
| Thermal Stability Test [168 Hours, 135° C. (275° F.) Copper, Steel Catalyst] | Cincinnati Milacron** | | |
| Sludge (Mg./100 ML.) | 2.2[3] | 1.2[3] | 0.9[3] |
| Condition of Cu Rod 5 Max. to pass, (CM Color Class)): | 2[3] | 3[3] | 1[3] |
| Condition of Fe Rod 1 Max. to pass, (CM Color Class): | 1[3] | 1[3] | 1[3] |
| Turbine Oil Rust Test Synthetic Seawater | | | |
| 24 Hrs: | | | |
| 48 Hrs: | | | |
| MISCELLANEOUS | | | |
| Turbine Oil Demulsibility 54.4° C. (130° F.) ML: Oil-Water-Emulsion (Minutes) | 40-40-0(15)[3] | 40-40-0(20)[3] | 40-40-0(10)[3] |
| Foam (Tendency-Stability) (ML.) | | | |
| Sequence I | | | |
| Sequence II | | | |
| Sequence III | | | |
| Seal Swell Test Percent change in Volume (Swell): | | +1.39 | +2.29[3] |

*ASTM unless otherwise indicated

**CM Color Class 1 = polished copper or steel 10 = black copper or steel

[1]Acid No. = 0.82

[2]Acid No. = 0.77

[3]Acid No. = 0.86

TABLE 5

| | PROCEDURE* | Hydraulic Oil A, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| **PUMP PERFORMANCE** | | | | | | | | |
| Vickers 104C Vane [2000 PSI, 1200 RPM, 65.6° C. (150°)] | D2882 (50 Mg. Max. Loss at 100 Hours to Pass) | | | | | | | |
| 100 Hours | | | | | | | | |
| Ring Loss, Mg: | | | | | | | | |
| Vane Loss, Mg: | | | | | | | | |
| Total Loss, Mg: | | | | | | | | |
| 300 Hours | | | | | | | | |
| Ring Loss, Mg: | | | | | | | | |
| Ring Loss, Mg: | | | | | | | | |
| Total Loss, Mg: | | | | | | | | |
| **OXIDATION & CORROSION** | | | | | | | | |
| Turbine Oil Oxidation | D943 | | | | | | | |
| Hours to 2.0 Neut. Nol: | | 1680 | 1860 | | | | | |
| Hydrolytic Stability | D2619 | | | | | | | |
| Copper Weight Loss: ($Mg./cm^2$) | | 2.47 | 1.78 | | | | | |
| Copper Appearance | | 1B | 2C | | | | | |
| Water Layer, Neut | | | | | | | | |
| Mo. Mg. KOH: | | 0.0 | 1.2 | | | | | |
| Water Layer: | | Basic | — | | | | | |
| Wear preventing characteristics of Lubricating FLuid (Four Ball Method), 1200 RPM, 75° C. (167° F.), 40 Kg., 1 hour, Wear Scar Diameter, mm: | D4172 | 0.561 | 0.512 | 0.455 | 0.432 | | | 0.455 |
| Thermal Stability Test [168 Hours, 135° C. (275° F.) Copper, Steel Catalyst] | Cincinnati Milacron** | | | | | | | |
| Sludge (Mg./100 ML.) | | 25.6 | 4.6 | | | | | |
| Condition of Cu Rod 5 Max. to pass, (CM Color Class): | | 10 | 1 | | | | | |
| Condition of Fe Rod 1 Max. to pass, (CM Color Class): | | 4 | 1 | | | | | |
| Turbine Oil Rust Test | D665 | | | | | | | |
| Synthetic Seawater | | | | | | | | |
| 24 Hrs: | | Pass | Pass | Pass | Pass | | | Pass |
| 48 Hrs: | | Pass | Pass | Pass | Pass | | | Pass |
| **MISCELLANEOUS** | | | | | | | | |
| Turbine Oil Demulsibility 54.4° C. (130° F.) ML: Oil-Water-Emulsion (Minutes) | D1401 | 40-40-0(40) | 40-40-0(15) | 40-40-0(20) | 40-40-0(15) | | | 40-40-0(30) |
| Foam (Tendency-Stability) (ML.) | D892 | | | | | | | |
| Sequence I | | 0–0 | 0–0 | | | | | |

TABLE 5-continued

| | PROCEDURE* | Hydraulic Oil A, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| Sequence II | | 20–0 | 20–0 | | | | | |
| Sequence III | | 0–0 | 0–0 | | | | | |
| Seal Swell Test Percent change in Volume (Swell): | D471 (+1–5% Increase in volume for Leak Reduction | −1.29 | +1.51 | +1.31 | +1.89 | | | +2.78 |

*ASTM unless otherwise indicated
**CM Color Class 1 = polished copper or steel 10 = black copper or steel

TABLE 6

| | PROCEDURE* | Hydraulic Oil B, with Used, Untreated | Treated with Example #1 | Treated with Example #2 | Treated with Example #3 | Treated with Example #4 | Treated with Example #5 | Treated Example #6 |
|---|---|---|---|---|---|---|---|---|
| PUMP PERFORMANCE | | | | | | | | |
| Vickers 104C Vane [2000 PSI, 1200 RPM, 65.6° C. (150°)] | D2882 (50 Mg. Max. Loss at 100 Hours to Pass) | | | | | | | |
| 100 Hours | | | | | | | | |
| Ring Loss, Mg: | | 52.2 | 21.2 | | | | | |
| Ring Loss, Mg: | | 2.2 | 1.3 | | | | | |
| Total Loss, Mg: | | 54.6 | 22.4 | | | | | |
| 300 Hours | | | | | | | | |
| Ring Loss, Mg: | 168.7 | 32.3 | | | | | | |
| Ring Loss, Mg: | 4.6 | 2.2 | | | | | | |
| Total Loss, Mg: | 172.7 | 34.6 | | | | | | |
| OXIDATION & CORROSION | | | | | | | | |
| Turbine Oil Oxidation Hours to 2.0 Neut. No: | D943 | 480 | 560 | | 812** | | | |
| Hydrolytic Stability Copper Weight Loss: ($Mg./cm^2$) | D2619 | 0.23 | 0.67 | | | | | |
| Copper Appearance | | 2B | 2B | | | | | |
| Water Layer, Neut | | | | | | | | |
| Mo. Mg. KOH: | | 28.9 | 26.0 | | | | | |
| Water Layer: | | Poor Separation Heavy Cuff | Poor Separation Heavy Cuff | | | | | |
| Wear preventing characteristics of Lubricating Fluid (Four Ball Method), 1200 RPM, 75° C. (167° F.), 40 Kg., 1 hour, Wear Scar Diameter, mm: | D4172 | 0.792 | 0.568 | | | | | |
| Thermal Stability Test [168 Hours, 135° C. (275° F.) Copper, Steel Catalyst] | Cincinnati Milacron*** | | | | | | | |
| Sludge (Mg./100 ML.) | | 26.0 | 8.7 | | | | | |
| Condition of Cu Rod 5 Max. to pass, (CM Color Class): | | 8 | 5 | | | | | |
| Condition of Fe Rod 1 Max. to pass, (CM Color Class): | | 4 | 2 | | | | | |
| Turbine Oil Rust Test Synthetic Seawater | D665 | | | | | | | |

TABLE 6-continued

| | PROCEDURE* | Hydraulic Oil B, with Used, Untreated | Treated with Example #1 | Treated with Example #2 | Treated with Example #3 | Treated with Example #4 | Treated with Example #5 | Treated Example #6 |
|---|---|---|---|---|---|---|---|---|
| 24 Hrs: | | Pass | Pass | | | | | |
| 48 Hrs: | | Fail | Pass | | | | | |
| MISCELLANEOUS | | | | | | | | |
| Turbine Oiil Demulsibility 54.4° C. (130° F.) | D1401 | 40-40-0(25) | 40-40-0(15) | 40-40-0(5) | 40-40-0(5) | | | |
| ML: Oil-Water-Emulsion (Minutes) | | | | | | | | |
| Foam (Tendency-Stability) (ML.) | D892 | | | | | | | |
| Sequence I | | 30–0 | 30–0 | | | | | |
| Sequence II | | 60–0 | 70–0 | | | | | |
| Sequence III | | 40–0 | 10–0 | | | | | |
| Seal Swell Test Percent change in Volume (Swell): | D471 (+1–5% Increase in volume for Leak Reduction | −1.32 | +1.75 | | | | | |

*ASTM unless otherwise indicated

**Neut. number at 812 hours was 2.16. Neut. number on Hydraulic Oil B, used was 1.55 when D943 test was started.

***CM Color Class 1 = polished copper or steel 10 = black copper or steel

TABLE 7

| | PROCEDURE* | Hydraulic Oil C, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| PUMP PERFORMANCE | | | | | | | | |
| Vickers 104C Vane [2000 PSI, 1200 RPM, 65.6° C. (150°)] | D2882 (50 Mg. Max. Loss at 100 Hours to Pass) | | | | | | | |
| 100 Hours | | | | | | | | |
| Ring Loss, Mg: | | 7.1 | 24.5 | | | | | |
| Vane Loss, Mg: | | 1.5 | 0.3 | | | | | |
| Total Loss, Mg: | | 8.6 | 24.8 | | | | | |
| 300 Hours | | | | | | | | |
| Ring Loss, Mg: | | | | | | | | |
| Ring Loss, Mg: | | | | | | | | |
| Total Loss, Mg: | | | | | | | | |
| OXIDATION & CORROSION | | | | | | | | |
| Turbine Oil Oxidation Hous to 2.0 Neut. No.: | D943 | 1440 | 1760 | | | 2480 | | |
| Hydrolytic Stability Copper Weight Loss: (Mg./cm²) | D2619 | | | | | | | |
| Copper Appearance | | | | | | | | |
| Water Layer, Neut | | | | | | | | |
| Mo. Mg. KOH: | | | | | | | | |
| Water Layer: | | | | | | | | |
| Wear preventing characteristics of Lubricating Fluid (Four Ball Method), 1200 RPM, 75° C. (167° F.), 40 Kg., 1 hour, Wear Scar | D4172 | 0.459 | 0.493 | | | 0.501 | | 0.592 |

TABLE 7-continued

| | PROCEDURE* | Hydraulic Oil C, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| Diameter, mm: | | | | | | | | |
| Thermal Stability Test [168 Hours, 135° C. (275° F.) Copper, Steel Catalyst] | Cincinnati Milacron** | | | | | | | |
| Sludge (mg./100 ML.) | | 38.8 | 0.5 | 1.0 | | | | |
| Condition of Cu Rod 5 Max. to pass, (CM Color Class): | | 8 | 2 | 1 | | 1 | | 1 |
| Condition of Fe Rod 1 Max. to pass, (CM Color Class): | | 4 | 1 | 1 | | 1 | | 1 |
| Turbine Oile Rust Test Synthetic Seawater | D665 | | | | | | | |
| 24 Hrs: | | Pass | Pass | | | Pass | | Pass |
| 48 Hrs: | | Pass | Pass | | | Pass | | Pass |
| MISCELLANEOUS | | | | | | | | |
| Turbine Oil Demulsibility 54.4° C. (130° F.) ML: Oil-Water-Emulsion (Minutes) | D1401 | 40-40-0(40) | 40-40-0(10) | 40-40-0(15) | | 40-40-0(10) | | 40-40-0(10) |
| Foam (Tendency-Stability) (ML.) | D892 | | | | | | | |
| Sequence I | | | | | | | | |
| Sequence II | | | | | | | | |
| Sequence III | | | | | | | | |
| Seal Swell Test Percent change in Volume (Swell): | D471 (+1–5% Increase in volume for Leak Reduction | −1.56 | +1.17 | | | +2.42 | | +2.80 |

*ASTM unless otherwise indicated
**CM Color Class 1 = plished copper or steel 10 = black copper or steel

TABLE 8

| | PROCEDURE* | Hydraulic Oil D, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| PUMP PERFORMANCE | | | | | | | | |
| Vickers 104C Vane [2000 PSI, 1200 RPM, (50 Mg. Max. 65.6° C. (150°)] | D2882 Loss at 100 Hours to Pass) | | | | | | | |
| 100 Hours | | | | | | | | |
| Ring Loss, Mg: | | 1.4 | 12.5 | | | | | |
| Vane Loss, Mg: | | 0.3 | 0.1 | | | | | |
| Total Loss, Mg: | | 1.7 | 12.6 | | | | | |
| 300 Hours | | | | | | | | |
| Ring Loss, Mg: | | | | | | | | |
| Ring Loss, Mg: | | | | | | | | |
| Total Loss, Mg: | | | | | | | | |
| OXIDATION & CORROSION | | | | | | | | |
| Turbine Oil Oxidation Hours to 2.0 Neut. No.: | D943 | 1800 | 1980 | | 2200 | | | |

TABLE 8-continued

| | PROCEDURE* | Hydraulic Oil D, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| Hydrolytic Stability Copper Weight Loss: (Mg./cm$^2$) Copper Appearance Water Layer, Neut | D2619 | | | | | | | |
| Mo. Mg. KOH: Water Layer: Wear preventing characteristics of Lubricating Fluid (Four Ball Method), 1200 RPM, 75° C. (167° F.), 40 Kg., 1 hour, Wear Scar Diameter, mm: | D4172 | 0.690 | 0.477 | | 0.569 | | | 0.501 |
| Thermal Stability Test [168 Hours, 135° C. (275° F.) Copper, Steel Catalyst] | Cincinnati Milacron** | | | | | | | |
| Sludge (Mg./100 ML.) | | 0.4 | 0.2 | | 1.7 | | | |
| Condition of Cu Rod 5 Max. to pass, (CM Color Class): | | 1 | 1 | | 1 | | | |
| Conditin of Fe Rod 1 Max. to pass, (CM Color Class): | | 1 | 1 | | 1 | | | |
| Turbine Oil Rust Test Synthetic Seawater | D665 | | | | | | | |
| 24 Hrs: | | Pass | Pass | | Pass | | | Pass |
| 48 Hrs: | | Pass | Pass | | Pass | | | Pass |
| MISCELLANEOUS | | | | | | | | |
| Turbine Oil Demulsibility 54.4° C. (130° F.) ML: Oil-Water-Emulsion (Minutes) | D1401 | 40-40-0(20) | 40-40-0(10) | | 40-40-0(20) | | | 40-40-0(10) |
| Foam (Tendency-Stability) (ML.) Sequence I Sequence II Sequence III | D892 | | | | | | | |
| Seal Swell Test Percent change in Volume (Swell): | D471 (+1–5% Increase in volume for Leak Reduction | +0.21 | +1.11 | | +1.69 | | | +2.49 |

*ASTM unless otherwise indicated
**CM Color Class 1 = polished copper or steel 10 = black copper or steel

TABLE 9

| | PROCEDURE* | Hydraulic Oil D, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| PUMP PERFORMANCE | | | | | | | | |
| Vickers 104C Vane [2000 PSI, 1200 RPM, 65.6° C. (150°)] | D2882 (50 Mg. Max. Loss at 100 Hours to Pass) | | | | | | | |
| 100 Hours | | | | | | | | |
| Ring Loss, Mg: | | | | | | | | |
| Vane Loss, Mg: | | | | | | | | |
| Total Loss, Mg: | | | | | | | | |

TABLE 9-continued

| | PROCEDURE* | Hydraulic Oil D, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| 300 Hours | | | | | | | | |
| Ring Loss, Mg: | | | | | | | | |
| Ring Loss, Mg: | | | | | | | | |
| Total Loss, Mg: | | | | | | | | |
| OXIDATION & CORROSION | | | | | | | | |
| Turbine Oil Oxidation | D943 | | | | | | | |
| Hours to 2.0 Neut. No: | | 1700 | 2860 | | | | | |
| Hydrolytic Stability | D2619 | | | | | | | |
| Copper Weight Loss: ($Mg./cm^2$) | | | | | | | | |
| Copper Appearance | | | | | | | | |
| Water Layer, Neut | | | | | | | | |
| Mo. Mg. KOH: | | | | | | | | |
| Water Layer: | | | | | | | | |
| Wear preventing characteristics of Lubricating Fluid (Four Ball Method), 1200 RPM, 75° C. (167° F.), 40 Kg., 1 hour, Wear Scar Diameter, mm: | D4172 | 0.455 | 0.387 | 0.319 | | | | 0.569 |
| Thermal Stability Test [168 Hours, 135° C. (275° F.) Copper, Steel Catalyst] | Cincinnati Milacron** | | | | | | | |
| Sludege (Mg./100 ML.) | | 2.6 | 0.60 | | | | | |
| Condition of Cu Rod 5 Max. to pass, (CM Color Class): | | 1 | 1 | | | | | |
| Condition of Fe Rod 1 Max. to pass, (CM Color Class): | | 1 | 1 | | | | | |
| Turbine Oil Rust Test | D665 | | | | | | | |
| Synthetic Seawater | | | | | | | | |
| 24 Hrs: | | Pass | Pass | Pass | | | | Pass |
| 48 Hrs: | | Pass | Pass | Pass | | | | Pass |
| MISCELLANEOUS | | | | | | | | |
| Turbine Oil Demulsibility 54.4° C. (130° F.) ML: Oil-Water-Emulsion (Minutes) | D1401 | 40-40-0(35) | 40-40-0(10) | 40-40-0(10) | | | | 40-40-0(10) |
| Foam (Tendency-Stability) (ML.) | D892 | | | | | | | |
| Sequence I | | | | | | | | |
| Sequence II | | | | | | | | |
| Sequence III | | | | | | | | |
| Seal Swell Test Percent change in Volume (Swell): | D471 (+1–5% Increase in volume for Leak Reduction | −0.55 | +0.64 | +1.22 | | | | +2.45 |

*ASTM unless otherwise indicated

**CM Color Class 1 = polished copper or steel 10 = black copper or steel

TABLE 10

| | PROCEDURE* | Hydraulic Oil D, New, Untreated | Treated with Example #1 | Treated with Example #2 | Treated with Example #3 | Treated with Example #4 | Treated with Example #5 | Treated with Example #6 |
|---|---|---|---|---|---|---|---|---|
| **PUMP PERFORMANCE** | | | | | | | | |
| Vickers 104C Vane [2000 PSI, 1200 RPM, 65.6° C. (150°)] | D2882 (50 Mg. Max. Loss at 100 Hours to Pass) | | | | | | | |
| 100 Hours | | | | | | | | |
| Ring Loss, Mg: | | 66.9 | | | | | | |
| Vane Loss, Mg: | | 247.2 | | | | | | |
| Total Loss, Mg: | | | | | | | | |
| 300 Hours | | | | | | | | |
| Ring Loss, Mg: | | | | | | | | |
| Ring Loss, Mg: | | | | | | | | |
| Total Loss, Mg: | | | | | | | | |
| OXIDATION & CORROSION | | | | | | | | |
| Turbine Oil Oxidation Hours to 2.0 Neut. No: | D943 | 2700 | | 3000 | | | | |
| Hydrolytic Stability Copper Weight Loss: (Mg./cm$^2$) | D2619 | | | | | | | |
| Copper Appearance | | | | | | | | |
| Water Layer, Neut | | | | | | | | |
| Mo. Mg. KOH: | | | | | | | | |
| Water Layer: | | | | | | | | |
| Wear preventing characteristics of Lubricating Fluid (Four Ball Method), 1200 RPM, 75° C. (167° F.), 40 Kg., 1 hour, Wear Scar Diameter, mm: | D4172 | 0.478 | 0.637 | 0.523 | | | | 0.660 |
| Thermal Stability Test [168 Hours, 135° C. (275° F.) Copper, Steel Catalyst] | Cincinnati Milacron** | | | | | | | |
| Sludge (Mg./100 ML.) | | 33.5 | 3.75 | | | | | |
| Conditoin of Cu Rod 5 Max. to pass, (CM Color Class): | | 3 | 1 | 3 | 1 | | | |
| Condition of Fe Rod 1 Max. to pass, (CM Color Class): | | 1 | 1 | 1 | 1 | | | |
| Turbine Oil Rust Test Synthetic Seawater | D665 | | | | | | | |
| 24 Hrs: | | | | Pass | | | | Pass |
| 48 Hrs: | | | | Pass | | | | Pass |
| MISCELLANEOUS | | | | | | | | |
| Turbine Oil Demulsibility 54.4° C. (130° F.) ML: Oil-Water-Emulsion (Minutes) | D1401 | | | 40-40-0(4.5) | 40-40-0(15) | 40-40-0(15) | | 40-40-0(5) |
| Foam (Tendency-Stability) (ML.) | D892 | | | | | | | |
| Sequence I | | | | | | | | |
| Sequence II | | | | | | | | |
| Sequence III | | | | | | | | |
| Seal Swell Test Percent change in Volume (Swell) | D471 (+1.5% Increase in volume for Leak Reduction | +0.51 | | +2.29 | | | | +2.80 |

*ASTM unless otherwise indicated

**CM Color Class 1 = polished copper or steel 10 = black copper or steel

We claim:

1. An additive useful for extending the service life of petroleum based hydraulic fluids, the additive comprising as essential elements a stabilized zinc dialkyldithiophosphate, a substituted sulfolane, an alkyl phenol and from about 5 percent to about 20 percent by weight of the additive of a solvent component selected from the group consisting of $C_9$–$C_{11}$ and $C_{12}$–$C_{13}$ alcohols, wherein the ratio of substituted sulfolane to alkyl phenol is about 3.2 to 1 and wherein the treat rate for the subject additive ranges from about 1.5 percent to about 13.5 percent by weight of the hydraulic fluid.

2. The additive of claim 1 wherein the solvent component further comprises octyl alcohol.

3. The additive of claim 1 wherein the solvent component further comprises amyl alcohol.

4. The additive of claim 1 wherein the solvent component further comprises hexyl alcohol.

5. The additive of claim 2 wherein the solvent component comprises a $C_9$–$C_{11}$ alcohol and octyl alcohol.

6. The additive of claim 5 wherein the solvent component consists essentially of about 50 weight percent $C_9$–$C_{11}$ alcohol and about 50 weight percent octyl alcohol.

7. The additive of claim 3 wherein the solvent component comprises $C_{12}$–$C_{13}$ alcohol and amyl alcohol.

8. The additive of claim 7 wherein the solvent component consists essentially of about 68 weight percent $C_{12}$–$C_{13}$ alcohol and about 32 weight percent hexyl alcohol.

9. The additive of claim 4 wherein the solvent component comprises $C_{12}$–$C_{13}$ alcohol and hexyl alcohol.

10. The additive of claim 9 wherein the solvent component consists essentially of about 63 weight percent $C_{12}$–$C_{13}$ alcohol and about 37 weight percent hexyl alcohol.

11. The additive of claim 1 wherein the solvent component comprises $C_9$–$C_{11}$ alcohol and an aromatic solvent.

12. The additive of claim 11 wherein the solvent component consists essentially of about 38 weight percent $C_9$–$C_{11}$ alcohol and about 62 weight percent aromatic solvent.

13. The additive of claim 11 wherein the solvent component comprises $C_9$–$C_{11}$ alcohol, an aromatic solvent and a ketone.

14. The additive of claim 13 wherein the solvent component consists essentially of about 36 weight percent $C_9$–$C_{11}$ alcohol, about 50 weight percent aromatic solvent, and about 14 weight percent ketone.

15. The additive of claim 13 wherein the ketone is methyl amyl ketone.

16. The additive of claim 14 wherein the ketone is methyl amyl ketone.

17. The additive of claim 11 wherein the aromatic solvent is an aromatic hydrocarbon solvent with a boiling range from about 362° F. to about 410° F.

18. The additive of claim 12 wherein the aromatic solvent is an aromatic hydrocarbon solvent with a boiling range from about 362° F. to about 410° F.

19. The additive of claim 13 wherein the aromatic solvent is an aromatic hydrocarbon solvent with a boiling range from about 362° F. to about 410° F.

20. The additive of claim 14 wherein the aromatic solvent is an aromatic hydrocarbon solvent with a boiling range from about 362° F. to about 410° F.

21. The additive of claim 15 wherein the aromatic solvent is an aromatic hydrocarbon solvent with a boiling range from about 362° F. to about 410° F.

22. The additive of claim 16 wherein the aromatic solvent is an aromatic hydrocarbon solvent with a boiling range from about 362° F. to about 410° F.

23. An additive useful for extending the service life of petroleum based hydraulic fluids, the additive comprising as essential elements a stabilized zinc dialkyldithiophosphate, a substituted sulfolane, an alkyl phenol and from about 5 percent to about 20 percent by weight of the additive of a solvent component comprising a mixture of $C_{14}$–$C_{15}$ alcohol and octyl alcohol, wherein the ratio of substituted sulfolane to alkyl phenol is about 3.2 to 1 and wherein the treat rate for the subject additive ranges from about 1.5 percent to about 13.5 percent by weight of the hydraulic fluid.

24. The additive of claim 23 wherein the solvent component consists essentially of about 34 weight percent $C_{14}$–$C_{15}$ alcohol and about 66 weight percent octyl alcohol.

25. A method for extending the service life of used petroleum based hydraulic fluid having an acid number of 1.5 or lower comprising the step of adding to the hydraulic fluid from about 1.5 percent to about 13.5 percent by weight of the hydraulic fluid of an additive comprising as essential elements a stabilized zinc dialkyldithiophosphate, a substituted sulfolane, an alkyl phenol and from about 5 percent to about 20 percent by weight of the additive of a solvent component selected from the group consisting of $C_9$–$C_{11}$ and $C_{12}$–$C_{13}$ alcohols, wherein the ratio of substituted sulfolane to alkyl phenol is about 3.2 to 1.

26. The method of claim 25 wherein the hydraulic fluid is an antiwear (AW) hydraulic fluid and wherein the additive is added to the hydraulic fluid at a treat rate equivalent to an amount ranging from about 6 to about 6.5 percent by weight of the hydraulic fluid where the additive comprises about 6.4 weight percent stabilized zinc dialkyldithiophosphate, about 6.4 weight percent substituted sulfolane, and about 2 weight percent alkyl phenol, all by weight of the additive.

27. The method of claim 25 wherein the hydraulic fluid is a rust and oxidation (R&O) hydraulic fluid and wherein the additive is added to the hydraulic fluid at a treat rate equivalent to an amount ranging from about 9.5 to about 13.5 percent by weight of the hydraulic fluid where the additive comprises about 6.4 weight percent stabilized zinc dialkyldithiophosphate, about 6.4 weight percent substituted sulfolane, and about 2 weight percent alkyl phenol, all by weight of the additive.

28. An additive for petroleum based hydraulic fluids that comprises as essential elements a stabilized zinc dialkyldithiophosphate; a substituted sulfolane; an alkyl phenol; and a solvent component consisting of at least about 3 percent by weight of the additive of an alcohol component selected from the group consisting of $C_9$–$C_{11}$ and $C_{12}$–$C_{13}$ alcohols, in combination with about 5 percent by weight of the additive of an aromatic hydrocarbon, wherein the ratio of substituted sulfolane to alkyl phenol is about 3.2 to 1 and wherein the treat rate for the subject additive ranges from about 1.5 percent to about 13.5 percent by weight of the hydraulic fluid.

29. A method for extending the service life of petroleum based hydraulic fluid comprising the step of adding to the hydraulic fluid from about 1.5 percent to about 13.5 percent by weight of an additive comprising as essential elements a stabilized zinc dialkyldithiophosphate; a substituted sulfolane; an alkyl phenol; and a solvent component consisting of at least about 3 percent by weight of the additive of an alcohol component selected from the group consisting of $C_9$–$C_{11}$ and $C_{12}$–$C_{13}$ in combination with about 5 percent by weight of the additive of an aromatic hydrocarbon, wherein the ratio of substituted sulfolane to alkyl phenol is about 3.2 to 1.

30. A method for increasing the concentration of zinc dialkyldithiophosphate and substituted sulfolane soluble in solvent neutral oil in an additive for petroleum based hydraulic fluid without separation when stored for 90 days at 120° F., said additive comprising substituted sulfolane, zinc dialkyldithiophosphate, an alkyl phenol and solvent component, by including in said additive a solvent component selected from the group consisting of:

a $C_9$–$C_{11}$ alcohol blend in an amount ranging from about 5 to about 20 weight percent of the additive;

a $C_{12}$–$C_{13}$ alcohol blend in an amount ranging from about 5 to about 20 weight percent of the additive;

an aromatic solvent blended with at least about 3 percent by weight of the additive of a $C_9$–$C_{11}$ alcohol blend;

an aromatic solvent blended with at least about 3 percent by weight of the additive of a $C_{12}$–$C_{13}$ alcohol blend;

an aromatic solvent and a ketone blended with at least about 3 percent by weight of the additive of a $C_9$–$C_{11}$ alcohol blend; and an aromatic solvent and a ketone blended with at least about 3 percent by weight of the additive of a $C_{12}$–$C_{13}$ alcohol blend, wherein the ratio of substituted sulfolane to alkyl phenol present in said additive is about 3.2 to 1 and wherein said additive is added to petroleum based hydraulic fluids in an amount of about 1.5 percent to about 13.5 percent by weight of the hydraulic fluid.

31. The additive of claim 28 wherein the aromatic is combined with a ketone.

32. The additive of claim 31 wherein the ketone is methyl amyl ketone.

33. The additive of claim 28 wherein the aromatic solvent is an aromatic hydrocarbon solvent with a boiling range from about 362° F. to about 410° F.

34. The method of claim 29 wherein the solvent component of the additive comprises a $C_9$–$C_{11}$ alcohol mixed with an aromatic hydrocarbon solvent.

35. The method of claim 34 wherein the aromatic hydrocarbon solvent has a boiling range from about 362° F. to about 410° F.

36. The method of claim 34 wherein the solvent component further comprises a ketone.

37. The method of claim 36 wherein the ketone is methyl amyl ketone.

* * * * *

UNITED STATES PATENT AND TRADEMARK OFFICE

CERTIFICATE OF CORRECTION

PATENT NO. : 5,700,765 Page 1 of 2

DATED : December 23, 1997

INVENTOR(S) : John Franklin Barnes, et al.

It is certified that error appears in the above-indentified patent and that said Letters Patent is hereby corrected as shown below:

Col. 9, line 60, delete "Table 5 and 6" and add –Tables 5 and 6--.

Col. 14, Table 1, line 2, column 3, delete "188.15" and replace with –88.15--.
Col. 14, Table 2-A, line 3, column 4, delete "68.78" and replace with –58.78--.
Col. 14, Table 2-A, line 5, column 10, delete "54.63" and replace with –54.53--.
Col. 15, Table 2-A, line 2, column 5, delete "28.53" and replace with –26.53--.
Col. 15, Table 2-B, line 8, column 16, delete "87.77" and replace with –67.88--.
Col. 15, Table 2-B, line 14, column 1, delete "Aroamtic" should read --Aromatic--
Col. 15, Table 2-B, line 15, column 26, delete "14.28" and replace with –14.29--.
Col. 15, Table 2-B, line 23, column 25, delete "146.26" and replace with –146.25--.
Col. 17, Table 3, line 3, column 1, move "(50 Mg. Max" to column 2 after "D2882".
Col. 19, Table 4, line 36, column 2, move "$3^2$" to column 3.
Col. 19, Table 4, line 36, column 4, delete "$1^3$".
Col. 19, Table 4, line 36, column 6, add --$1^3$--.
Col. 21, Table 4, line 44, column 4, delete "40-40-0$(10)^3$" and replace with –40-40-0$(10)^2$--.
Col. 23, Table 5, line 15, column 1, delete "Nol:" and replace with –No.:--.
Col. 25, Table 6, line 7, column 1, delete "Ring" and replace with –Vane--.
Col. 25, Table 6, line 10, column 2, move "168.7" to column 3.
Col. 25, Table 6, line 11, column 2, move "4.6" to column 3.
Col. 25, Table 6, line 12, column 2, move "172.7" to column 3.
Col. 25, Table 6, line 10, column 3, move "32.3" to column 4.
Col. 25, Table 6, line 11, column 3, move "2.2" to column 4.
Col. 25, Table 6, line 12, column 3, move "34.6" to column 4.

UNITED STATES PATENT AND TRADEMARK OFFICE

CERTIFICATE OF CORRECTION

PATENT NO. : 5,700,765 Page 2 of 2

DATED : December 23, 1997

INVENTOR(S) : John Franklin Barnes, et al.

It is certified that error appears in the above-indentified patent and that said Letters Patent is hereby corrected as shown below:

Col. 27, Table 6, line 4, column 1, delete "Oiil" and replace with –Oil--.
Col. 29, Table 7, line 13, column 1, delete "Oile" and replace with –Oil--.
Col. 29, Table 7, line 2 of table footnote, delete "plished" and replace with –polished--.
Col. 29, Table 8, line 4, column 1, move "(50 Mg. Max." to column 2.
Col. 31, Table 8, line 23, column 1, delete "Conditin" should read --Condition--
Col. 31, Table 9, line 2, column 1 of the table header, delete "Oil D," and replace with –Oil E--.
Col. 35, Table 10, line 2, column 2 of the table header, delete "Oil D" and replace with –Oil F--.

Signed and Sealed this

Third Day of November, 1998

*Attest:*

*Attesting Officer*

Bruce Lehman

BRUCE LEHMAN

*Commissioner of Patents and Trademarks*